US006719548B1

(12) United States Patent
Heizer

(10) Patent No.: US 6,719,548 B1
(45) Date of Patent: Apr. 13, 2004

(54) TWIN SCREW ROTOR DEVICE

(75) Inventor: Charles K. Heizer, St. Louis, MO (US)

(73) Assignee: Imperial Research LLC, Pevely, MO (US)

( * ) Notice: Subject to any disclaimer, the term of this patent is extended or adjusted under 35 U.S.C. 154(b) by 0 days.

(21) Appl. No.: 10/283,422

(22) Filed: Oct. 29, 2002

(51) Int. Cl.[7] ..... F01C 1/16

(52) U.S. Cl. ..... 418/201.3; 418/201.1; 418/197

(58) Field of Search ..... 418/201.3, 201.1, 418/197

(56) References Cited

U.S. PATENT DOCUMENTS

| | | | | | |
|---|---|---|---|---|---|
| 726,969 | A | | 5/1903 | Motsinger | |
| 2,511,878 | A | | 6/1950 | Rathman | |
| 2,656,972 | A | | 10/1953 | Rathman | |
| 2,705,922 | A | | 4/1955 | Rathman | |
| 2,931,308 | A | * | 4/1960 | Luthi | 418/201.1 |
| 2,994,562 | A | | 8/1961 | Zalis | |
| 3,138,110 | A | * | 6/1964 | Whitfield | 418/201.3 |
| 3,170,566 | A | * | 2/1965 | Zimmermann | 418/201.1 |
| 3,282,495 | A | * | 11/1966 | Walls | 418/201.1 |
| 3,677,664 | A | | 7/1972 | Wycliffe et al. | |
| 3,841,805 | A | * | 10/1974 | Zalis | 418/201.1 |
| 5,800,151 | A | | 9/1998 | Kawamura et al. | |
| 6,244,844 | B1 | | 6/2001 | Diaz | |

FOREIGN PATENT DOCUMENTS

| | | | | |
|---|---|---|---|---|
| GB | 648055 | | 12/1950 | |
| JP | 63302191 | A * | 12/1988 | F04C/18/16 |
| JP | 01208587 | A * | 8/1989 | F04C/18/16 |

* cited by examiner

*Primary Examiner*—Thomas Denion
*Assistant Examiner*—Theresa Trieu
(74) *Attorney, Agent, or Firm*—Dennis J. M. Donahue, III; Grant D. Kang; Husch & Eppenberger LLC

(57) ABSTRACT

A screw rotor device has a housing with an inlet port and an outlet port and at least one pair of rotors. The rotors each have an identical number of threads (N), a buttress thread profile with a diagonal line, and a length that is either approximately equal to or less than a single pitch of the threads. The threads of the rotors intermesh as the rotors counter-rotate with respect to each other. The rotors can be twins or each one of the rotors can have different profiles.

20 Claims, 6 Drawing Sheets

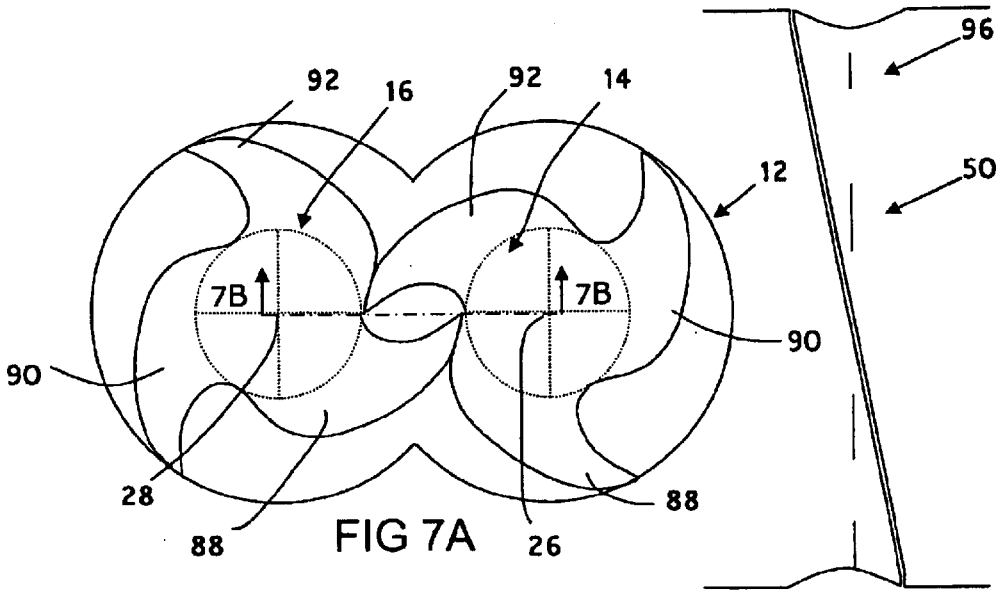
FIG 7A
FIG 7B
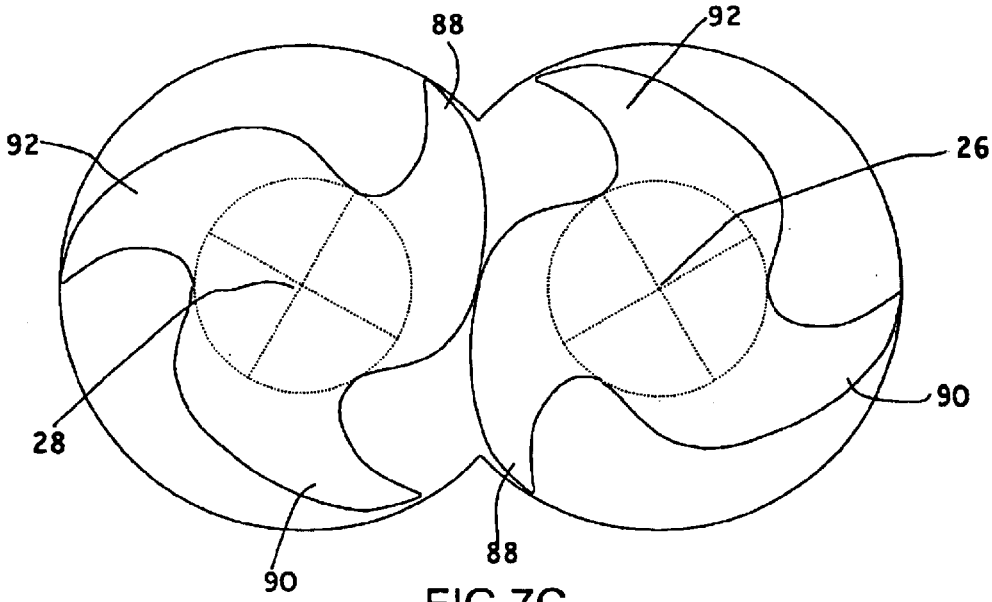
FIG 7C

TWIN SCREW ROTOR DEVICE

CROSS-REFERENCE TO RELATED APPLICATIONS

This application is related to U.S. application Ser. No. 10/283,421 filed on Oct. 29 , 2002, which is a continuation-in-part of U.S. Pat. No. 6,599,112.

BACKGROUND OF THE INVENTION

1. Field of the Invention

This invention relates generally to rotor devices and, more particularly to screw rotors.

2. Description of Related Art

Screw rotors are generally known to be used in compressors, expanders, and pumps. For each of these applications, a pair of screw rotors have helical threads and grooves that intermesh with each other in a housing. For an expander, a pressurized gaseous working fluid enters the rotors, expands into the volume as work is taken out from at least one of the rotors, and is discharged at a lower pressure. For a compressor, work is put into at least one of the rotors to compress the gaseous working fluid. Similarly, for a pump, work is put into at least one of the rotors to pump the liquid. The working fluid, either gas or liquid, enters through an inlet in the housing, is positively displaced within the housing as the rotors counter-rotate, and exits through an outlet in the housing.

The rotor profiles define sealing surfaces between the rotors themselves between the rotors and the housing, thereby sealing a volume for the working fluid in the housing. The profiles are traditionally designed to reduce leakage between the sealing surfaces, and special attention is given to the interface between the rotors where the threads and grooves of one rotor respectively intermesh with the grooves and threads of the other rotor. The meshing interface between rotors must be designed such that the threads do not lock-up in the grooves, and this has typically resulted in profile designs similar to gears.

However, a gear tooth is primarily designed for strength and to prevent lock-up as teeth mesh with each other and are not necessarily optimum for the circumferential sealing of rotors within a housing. As discussed above, threads must provide seals between the rotors and the walls of the housing and between the rotors themselves, and there is a transition from sealing around the circumference of the housing to sealing between the rotors. In this transition, a gap is formed between the meshing threads and the housing, causing leaks of the working fluid through the gap in the sealing surfaces and resulting in less efficiency in the rotor system.

Some arcuate profile designs improve the seal between rotors by minimizing the gap in this transition region. Single thread profiles can result in imbalances in the rotors when rotated at high speeds and multiple thread profiles allow for leaks between the positive displacement flow regions bounded by the multiple threads. The leaks between multiple threads in these rotors can be significant in prior art designs because the rotor length extends beyond a single pitch of the threads. However, many of the prior art thread designs use multiple pitch threads. Additionally, these designs are based on multiple curves in a lengthwise cross-section. Multiple curves impose manufacturing constraints that adversely impact the ability to manufacture the rotors and to maintain close tolerances between the rotors.

BRIEF SUMMARY OF THE INVENTION

It is in view of the above problems that the present invention was developed. The invention features a screw rotor device having an identical number of threads (N), a buttress thread profile with a diagonal line, and a length that is either approximately equal to or less than a single pitch of the threads. Another feature of the invention is the cross-sectional shape of the rotors. In particular, for twin rotors, the cross-sectional shape is identical. The features of the invention result in an advantage of improved efficiency and manufacturability of the screw rotor device.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIG. 7A illustrates a cross-sectional view of another alternative twin rotor embodiment for the screw rotor device;

FIG. 7B illustrates a lengthwise cross-sectional view of the alternative twin rotor embodiment taken along line 7B—7B of FIG. 7A;

FIG. 7C illustrates the same cross-sectional view of the screw rotor device illustrated in FIG. 7A after the twin rotors have been rotated approximately 60°;

DETAILED DESCRIPTION OF THE INVENTION

Figure 1:
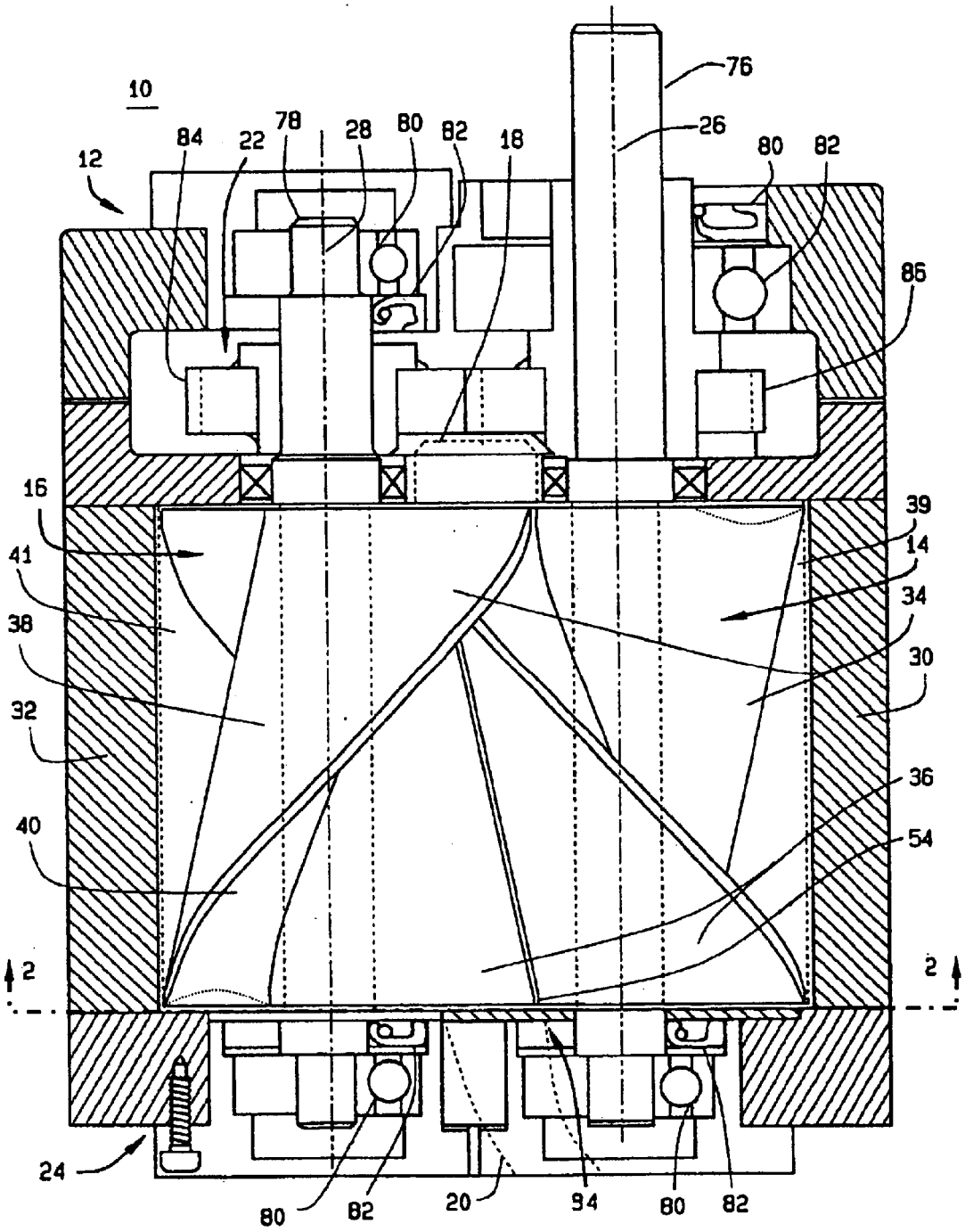
FIG. 1 illustrates a lengthwise cross-sectional view of a screw rotor device according to the present invention.

Referring to the accompanying drawings in which like reference numbers indicate like elements, FIG. 1 illustrates an axial cross-sectional schematic view of a screw rotor device 10. The screw rotor device 10 generally includes a housing 12 and a pair of rotors 14, 16. The housing 12 has an inlet port 18 and an outlet port 20. The inlet port 18 is preferably located at the gearing end 22 of the housing 12, and the outlet port 20 is located at the opposite end 24 of the housing 12. The rotors 14, 16 intermesh as they respectively counter-rotate about a pair of substantially parallel axes 26, 28 within a pair of cylindrical bores 30, 32 extending between ends 22, 24.

Generally, each one of the rotors 14, 16 has an identical number (N) of helical threads, and in the preferred embodiment, each one of the rotors 14, 16 has a pair of helical threads 34, 36. Each one of the helical threads 34, 36 preferably has a convex side 38 and a concave side 40. As the rotors 14, 16 counter-rotate with respect to each other, the helical threads 34, 36 on one of the rotors 14 respectively intermesh in phase with the helical threads 34, 36 on the other rotor 16. In this manner, the working fluid flows through the inlet port 18 and into the screw rotor device 10 in the spaces 39, 41 bounded on each side of the helical threads 34, 36, the cylindrical bores 30, 32, and the ends 22, 24 of the housing 12. The spaces 39, 41 are alternatively opened to and closed off from the inlet port 18 as the helical threads 34, 36 intermesh. As the rotors 14 continue to counter-rotate, the working fluid is positively displaced toward and through the outlet port 20.

Figure 2:
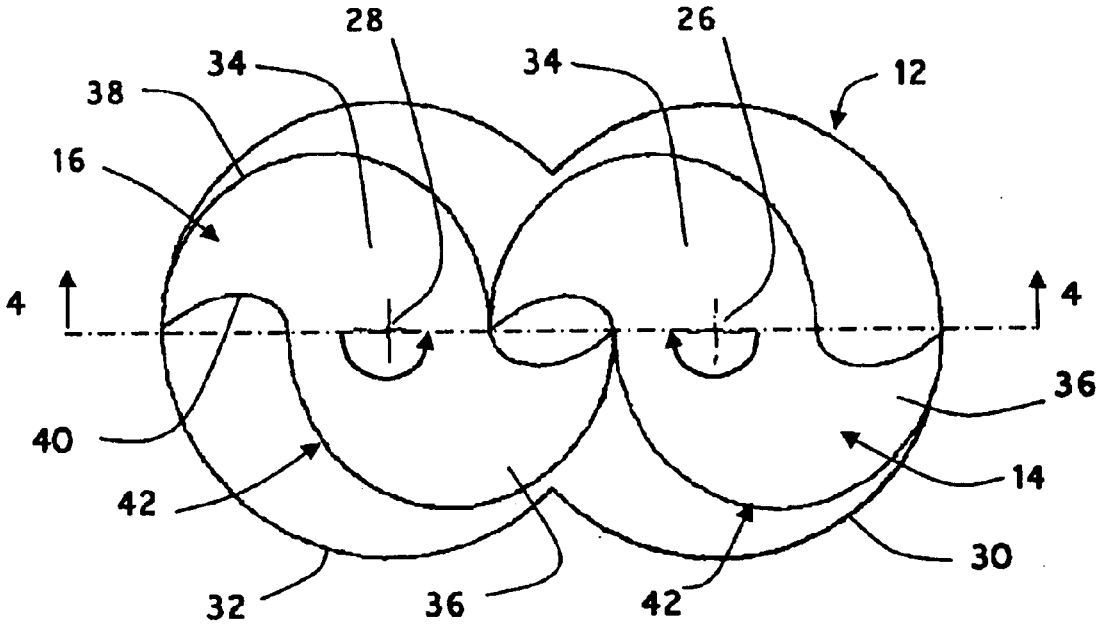
FIG. 2 illustrates a cross-sectional view of the screw rotor device taken along line 2—2 of FIG. 1.
Figure 3:
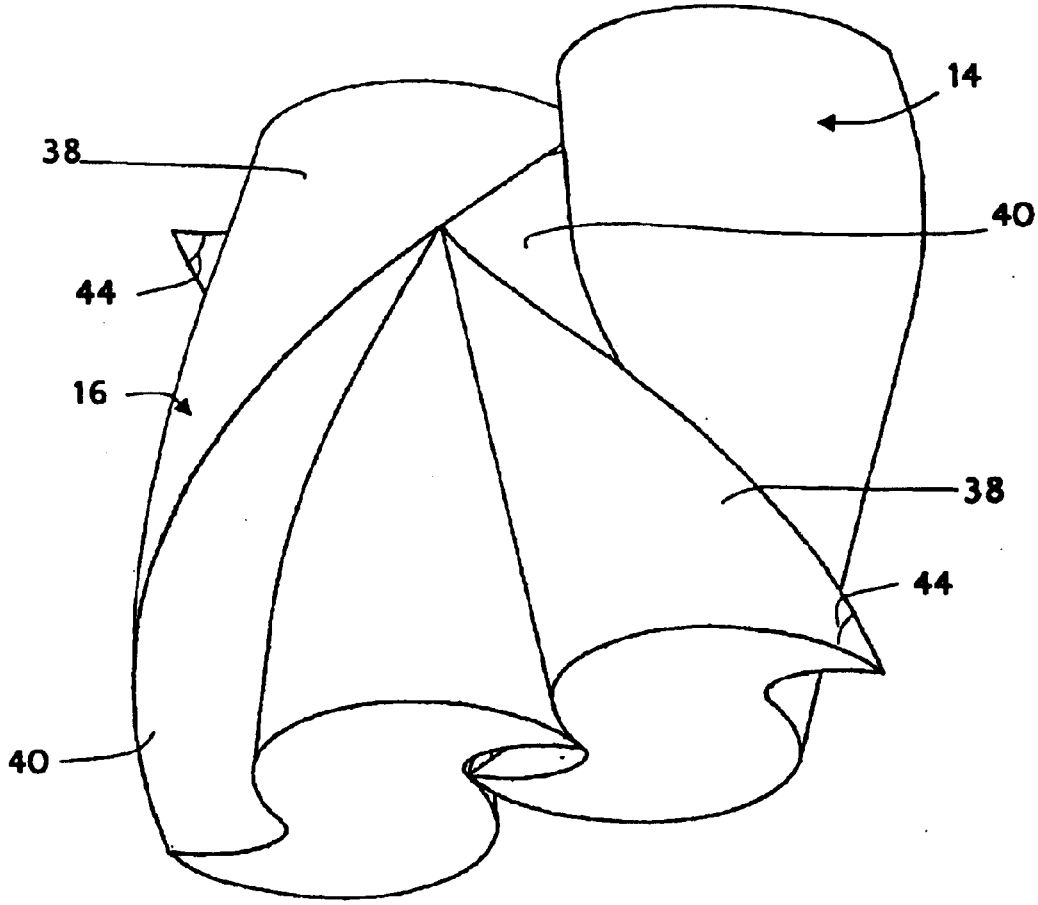
FIG. 3 illustrates an isometric view of a pair of twin rotors for the screw rotor device.

The intermeshing rotors 14, 16 are preferably twin rotors, as described in reference to FIGS. 2 and 3. In particular, the rotors 14, 16 are twins in nature because they have an identical concave/convex cross-sectional shape 42 in the plane perpendicular to the axes of rotation 26, 28. The rotors 14, 16 counter-rotate with each other and intermesh without locking up because their threads 34, 36 have opposite-handed helix angles 44. The concave/convex shape 42 generally includes a major diameter arc 46, a minor diameter arc 48, and concave and convex curves between the major and minor diameter arcs 46, 48. The concave and convex curves respectively correspond to the concave and convex sides 40, 38 of the helical threads 34, 36. The concave curve 40 on each one of the rotors 14, 16 is preferably defined by the path of the major diameter arc 46 on the other one of the rotors 14, 16, respectively, and the convex curve 40 preferably has a continually decreasing radius from the radius of the major diameter 46 to the radius of the minor diameter 48. As the rotors 14, 16 counter-rotate, the radius of the convex curve 40 on one of the rotors 14, 16 decreases while the radius of the identical convex curve 40 on the other one of the rotors 16, 14 respectively increases, thereby maintaining the helical threads 34, 36 in closest proximity to each other between the axes of rotation 26, 28. In the preferred embodiment, the major diameter of the rotors 14, 16 is approximately twice as long as the minor diameter of the rotors 14, 16.

Figure 4:
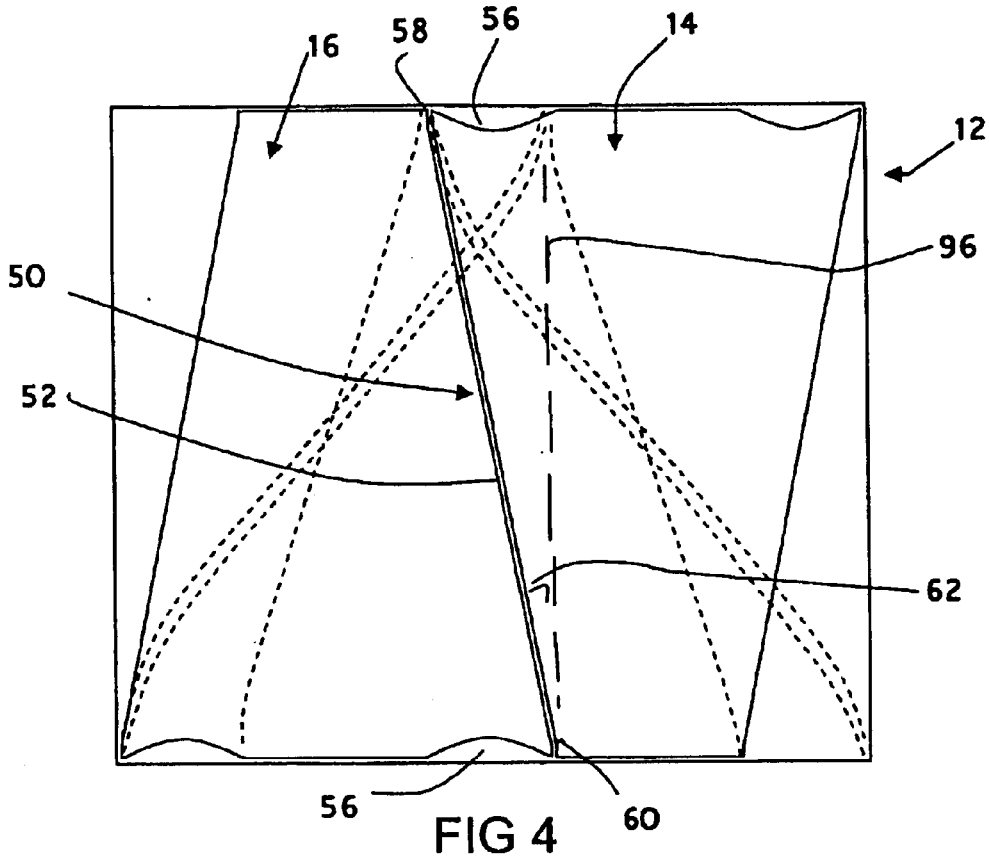
FIG. 4 illustrates a lengthwise cross-sectional view of the screw rotor device taken along line 4—4 of FIG. 2.
Figure 5:
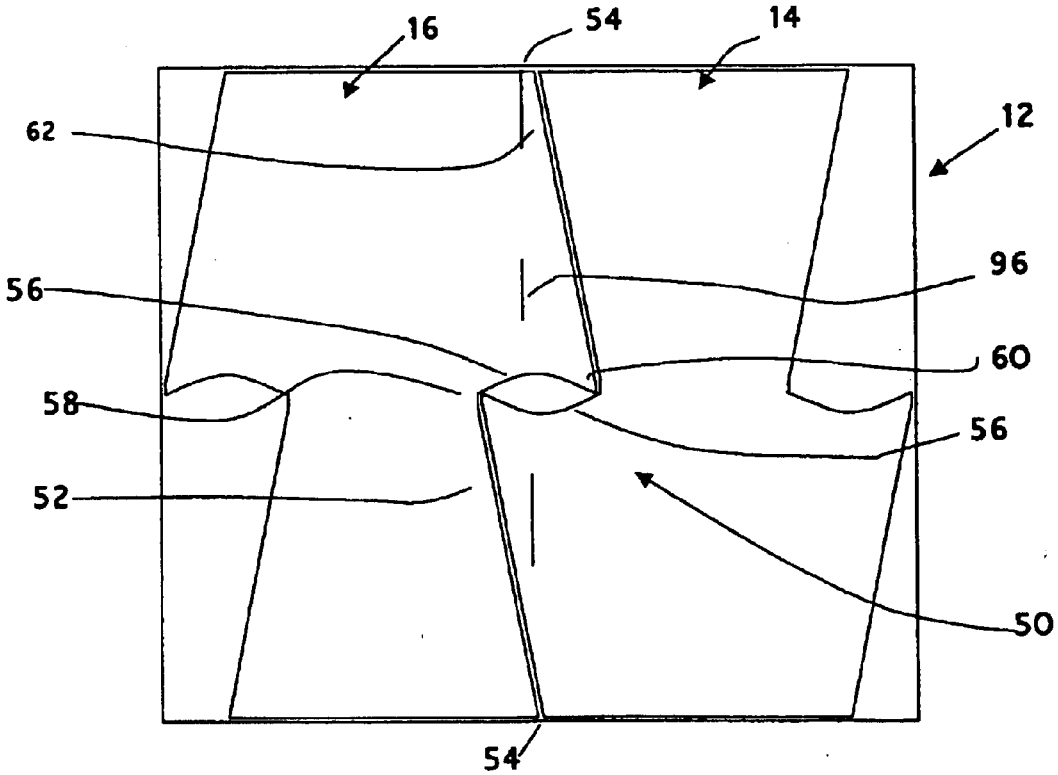
FIG. 5 illustrates the same lengthwise cross-sectional view of the screw rotor device illustrated in FIG. 4 after the twin rotors have been rotated approximately 90°.

According to the present invention and described in reference to FIGS. 4 and 5, the tightest tolerances between the helical threads 34, 36 can be maintained by defining the line of closest proximity therebetween according to a buttress thread shape 50. In particular, the buttress thread shape 50 includes parallel straight diagonal lines 52 that almost span the entire length of the housing 12, with only a slight gap 54 between the rotors 14, 16 and the ends 22, 24 of the housing 12. The buttress thread shape 50 also includes a pair of juxtaposed concave lines 56 between the parallel straight diagonal lines 52. Although it is possible for the parallel straight diagonal lines 52 to span the length of the housing 12, such a design would create an extremely sharp edge between the helical threads 34, 36 and the cylindrical bores 30, 32. As the rotors 14, 16 counter-rotate, a pressure differential is produced on either side of the helical threads 34, 36 and a sharp edge between the helical threads 34, 36 creates a Venturi effect that increases the leakage in the region between the helical threads 34, 36 and the cylindrical bores 30, 32. Therefore, the buttress thread shape 50 also preferably includes two pairs of straight lines 58, 60 that are located between the parallel straight diagonal lines 52 and the juxtaposed concave lines 56. The straight lines 58, 60 can be rather short an still improve the sealing between the helical threads 34, 36 and the cylindrical bores 30, 32. In the preferred embodiment, the parallel straight diagonal lines 52 are more than three times as long the straight lines 58, 60 combined. The straight lines 58, 60 are substantially parallel to the axes of rotation 26, 28 and are offset from each other. Additionally, the straight lines 58, 60 are preferably the same length.

Figure 6A:
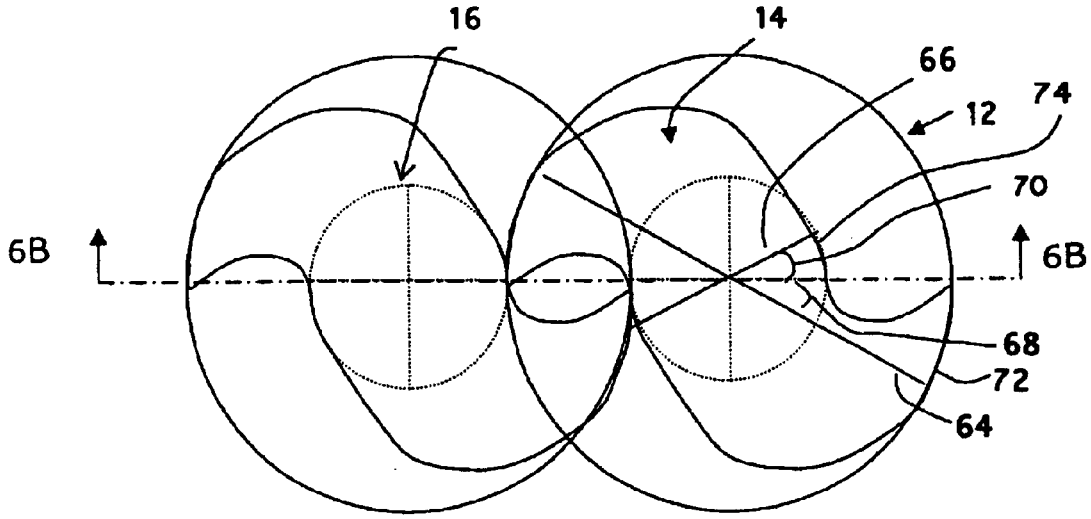
FIG. 6A illustrates a cross-sectional view of an alternative twin rotor embodiment for the screw rotor device.
Figure 6B:
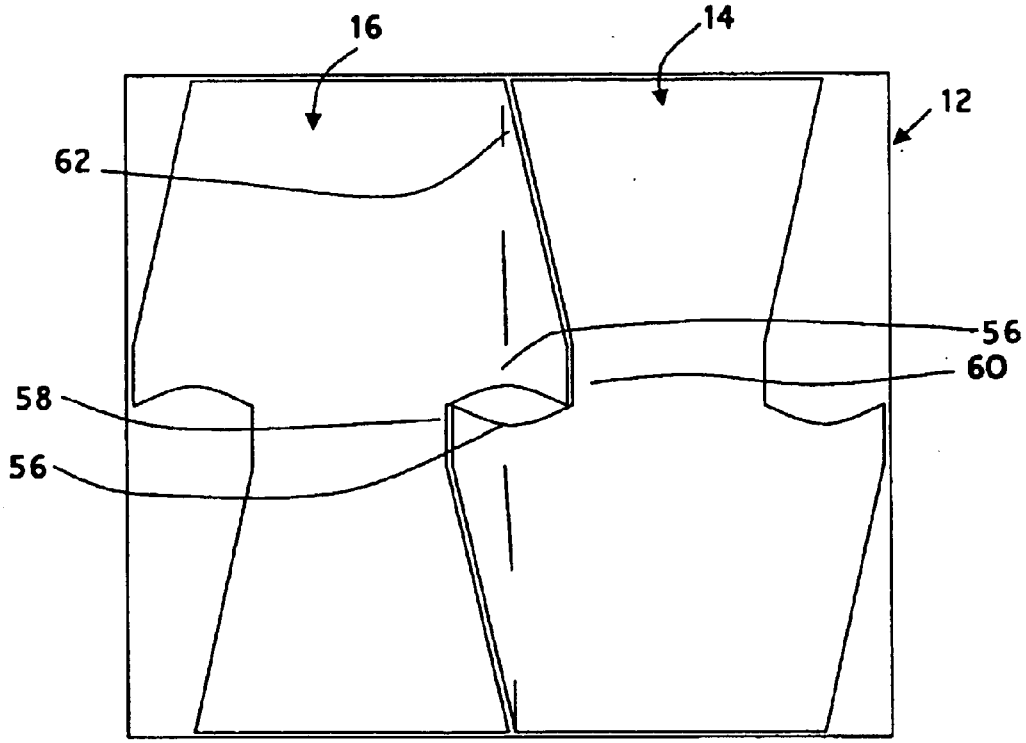
FIG. 6B illustrates a lengthwise cross-sectional view of the alternative twin rotor embodiment taken along line 6B—6B of FIG. 6A.

Generally, the convex curve 40 for each one of the rotors 14, 16 is defined by the slope 62 of the parallel straight diagonal lines 52 and by the diameters 64, 66 and arc angles 68, 70 of the major and minor diameters 72, 74, respectively. In FIGS. 6A and 6B, the arc angles 68, 70 are increased from the preferred embodiment. By increasing the arc angles 68, 70, the length of the straight lines 58, 60 and the parallel straight diagonal lines 52 are respectively increased and decreased according to the helix angle 44, thereby causing the slope 62 of the parallel straight diagonal lines 52 to change.

As particularly illustrated in FIG. 1, the pair of rotors 14, 16 has a respective central shaft 76, 78 in each one of these embodiments. The shafts 76, 78 are rotatably mounted within the housing 12 through bearings 80 and seals 82. The rotors 14, 16 are preferably linked to each other through a pair of counter-rotating gears 84, 86 that are respectively attached to the shafts 76, 78. The central shaft 76 of one of the rotors 14 has one end extending out of the housing 12. When the screw rotor device 10 operates as a compressor, shaft 76 is rotated causing the corresponding rotor 14 to rotate. The actuated rotor 14 causes the other rotor 16 to counter-rotate through the gears 84, 86, and the rotors 14, 16 intermesh with each other.

Although each one of the rotors 14, 16 has an identical number (N) of helical threads, the particular number of helical threads 34, 36 can vary. For example, FIGS. 7A, 7B and 7C show rotors 14, 16 that each have three helical threads 88, 90, 92. As in the preferred embodiment, these rotors 14, 16 also have a buttress thread profile 50. As illustrated in FIG. 7C, the radius of the convex curve 40 on one of the rotors 14, 16 decreases while the radius of the identical convex curve 40 on the other one of the rotors 16, 14 respectively increases as the rotors 14, 16 counter-rotate, thereby maintaining the helical threads 34, 36 in closest proximity to each other between the axes of rotation 26, 28. For balancing each one of the rotors 14, 16 on their respective shafts 76, 78, it is preferable to have multiple helical threads 34, 36, although it will be appreciated that a single helical thread can also be used.

In the preferred embodiment of the present invention, the screw rotor device 10 operates as a screw compressor on a gaseous working fluid. When operating as a screw compressor, the screw rotor device 10 preferably includes a valve 94 in operative fluid communication with the outlet port 20. As particularly disclosed in the co-pending application having Ser. No. 10/013,747, which is hereby incorporated by reference, the valve 94 may be a pressure timing plate attached to and rotating with one of the rotors. The valve 94 may alternatively be a reed valve attached to the housing 12. It will also be appreciated that the valve 94 can be other types of pressure-actuated and mechanically-actuated valves. A computer control system (not shown) could be used to control the valve 94 with actuators based on inputs from sensors. Additionally, a valve may also be used in controlling the entry of fluid into the screw rotor device 10 through the inlet port 18.

The screw rotor device 10 can be also be used as an expander. When acting as an expander, gas having a pressure higher than ambient pressure enters the screw rotor device 10 through the outlet port 20. A valve system may also be used in controlling the expansion of the gas through the screw rotor device 10. The pressure of the gas forces rotation of the rotors 14, 16. As the gas expands into the alternating spaces 39, 41, work is extracted through the end of shaft 76 that extends out of the housing 12. The pressure in the spaces 39, 41 decreases as the gas moves towards the inlet port 18 and exits into ambient pressure at the inlet port 18. The screw rotor device 10 can operate with a gaseous working fluid and may also be used as a pump for a liquid working fluid. For pumping liquids, a valve may also be used to prevent the fluid from backing into the rotor.

The present invention is generally directed toward screw rotor devices 10 having rotors 14, 16 with the identical number of threads (N), a buttress thread profile 50 and a length that is either approximately equal to or less than a single pitch 96 of the helical threads 34, 36. The pitch of a screw is generally defined as the distance from any point on a screw thread to a corresponding point on the next thread, measured parallel to the axis and on the same side of the axis. Each embodiment of the screw rotor device 10 illustrated in FIGS. 1–6 has a pair of helical threads 34, 36. Therefore, a 180° helical twist of the helical threads 34, 36 produces a single pitch of the helical threads 34, 36. In comparison, the embodiment of the screw rotor device 10 illustrated in FIGS. 7A, 7B and 7C has three helical threads 88, 90, 92. Therefore, a 120° helical twist of the helical threads 88, 90, 92 produces a single pitch of the helical threads 88, 90, 92. In general, the helical twist required to provide the single pitch is merely defined by the number of helical threads (N=1, 2, 3, 4, . . . ) according to equation (1) below.

$$\text{Single Pitch Helical Twist}=360°/N \quad (1)$$

Figure 8A:
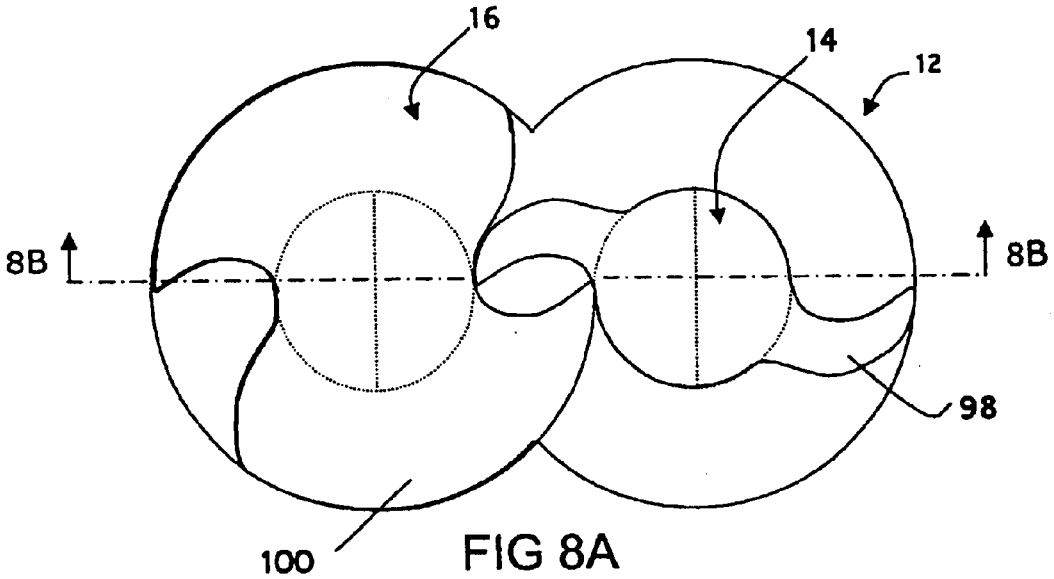
FIG. 8A illustrates a cross-sectional view of yet another rotor embodiment for the screw rotor device.
Figure 8B:
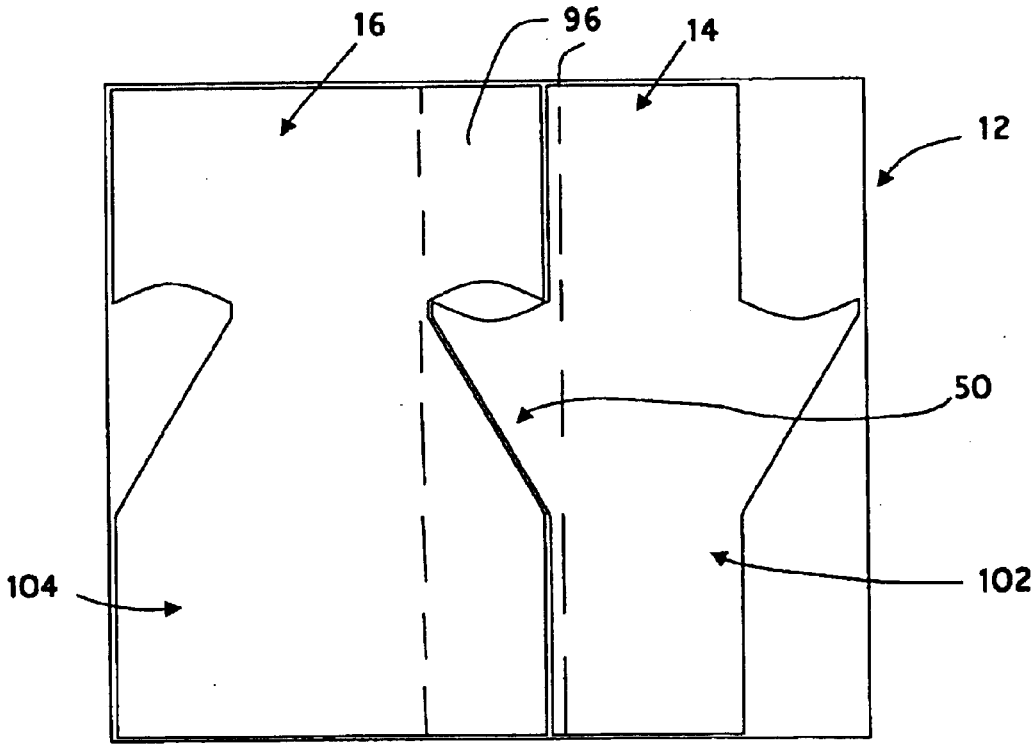
FIG. 8B illustrates a lengthwise cross-sectional view of the alternative twin rotor embodiment taken along line 8B—8B of FIG. 8A.

In each of the embodiments illustrated in FIGS. 1–7, the rotors 14, 16 are twins, having an identical concave/convex cross-sectional shape 42 in the plane perpendicular to the axes of rotation 26, 28. However, the screw rotor device 10 may also have rotors 14, 16 with that are not twins although the rotors 14, 16 may still have the identical number of threads (N), a buttress thread profile 50, and a length that is no greater than approximately a single pitch 96. FIG. 8A illustrates an example of one such design in which one of the rotors 14, 16 has a pair of helical threads with different concave/convex cross-sectional shapes 98, 100. As illustrated in FIG. 8B, the different concave/convex cross-sectional shapes 98, 100 result in different lengthwise profiles 102, 104 for the rotors 14, 16. In comparison, the lengthwise profile in each of the other embodiments is the same shape, merely being up-side-down with respect to each other.

Of course, it will be appreciated that although the length of the screw rotor device 10 is limited to approximately a single pitch 96 of the helical threads 34, 36, the pitch length can be changed by altering the helix angle 44 of the helical threads 34, 36. The pitch length increases as the helix angle 44 steepens. Additionally, for rotors having given diameters, the helix angle 44 will steepen as the number of thread increases. For example, the three-thread embodiment illustrated in FIG. 7A has the same major and minor diameters as the two-thread embodiment illustrated in FIG. 2, and these embodiments also have approximately the same arc angle for the major and minor diameters. Therefore, although both of these embodiments have a buttress thread shape 50 with approximately the same slope 62, the rotors 14, 16 in these embodiments do not have the same helix angle 44 because the three-thread embodiment has a 180° helical twist whereas the two-thread embodiment only has a 120° helical twist. Therefore, the three-thread embodiment has a steeper helix angle 44 than the two-thread embodiment.

As discussed above, the diameters 64, 66 and arc angles 68, 70 of the major and minor diameters 72, 74, respectively, are also variable. It should also be appreciated that more than two rotors can also be used according to the present invention and that the rotors may have different major and minor diameters. Additionally, it should be appreciated that the axes of the rotors do not necessarily need to be parallel with respect to each other, although it is preferable for the axes to be in the same plane. Therefore, according to the several aspects of the present invention as set forth in the following claims and described herein, the screw rotor device 10 can have alternative designs.

The foregoing embodiments illustrate the screw rotor device 10 according to several aspects of the present invention. The rotors 14, 16 generally fit within the housing 12 according to close tolerances, such as the gap 54 discussed above, and it should be appreciated that the benefits of the present invention can be achieved within manufacturing tolerances, such as in the parallel diagonal straight lines 52 of the buttress thread profile 50. In particular, tolerances in the parallel diagonal straight lines 52 may allow for a slight radius of curvature between the diagonal lines and the major and minor diameters and an extremely slight divergence in the parallelism. It will be appreciated that manufacturing tolerances may vary depending on the type of material being used, such as metals, ceramics, plastics, and composites thereof, and depending on the manufacturing process, such as machining, extruding, casting, and combinations thereof.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A screw rotor device for positive displacement of a working fluid, comprising:

a housing having an inlet port at a first end and an outlet port at a second end and a pair of cylindrical bores extending therebetween;

a pair of intermeshing rotors rotatably mounted about a respective pair of axes between said first end and said second end of said housing, wherein said pair of rotors have an identical number of helical threads and a length approximately equal to a single pitch of said helical threads, said helical threads having a buttress thread shape in a lengthwise cross-section of said pair of rotors in a plane extending between said pair of axes, wherein said buttress thread shape is comprised of parallel straight diagonal lines and a pair of opposing concave lines.

2. The screw rotor device according to claim 1, wherein said buttress thread shape is further comprised of a first pair of straight lines substantially parallel to said pair of axes and located between said parallel straight diagonal lines and said opposing concave lines.

3. The screw rotor device according to claim 2, wherein said first pair of straight lines are approximately the same length for each rotor and said parallel straight diagonal lines are more than three times as long as said first pair of straight lines.

4. The screw rotor device according to claim 3, wherein said buttress thread shape is further comprised of a second pair of straight lines substantially parallel to and offset from said first pair of straight lines, wherein said second pair of straight lines are substantially the same length as said first pair of straight lines.

5. The screw rotor device according to claim 3, further comprising a second pair of straight line substantially parallel to and offset from said first pair of straight line, wherein said second pair of straight lines have a different length from said first pair of straight lines.

6. The screw rotor device according to claim 1, wherein each one of said pair of rotors has a concave/convex cross-sectional shape in a plane perpendicular to said pair of axes, wherein said concave/convex cross-sectional shape is comprised of a major diameter arc, a minor diameter arc, a concave curve between said major diameter arc and said minor diameter arc and a convex curve between said minor diameter arc and said major diameter arc, wherein said concave curve on each one of said pair of rotors is defined by a path of said major diameter arc on the other of said pair of rotors and said convex curve for each of said pair of rotors is defined by a slope of said parallel straight diagonal lines and by a diameter and arc angle of said major diameter arc and said minor diameter arc.

7. The screw rotor device according to claim 6, wherein said concave/convex cross-sectional shape is identical for said pair of rotors.

8. The screw rotor device according to claim 1, further comprising a valve in fluid communication with said outlet port, wherein said pair of rotors confine the working fluid to a space within said housing that is in fluid communication with said outlet port.

9. The screw rotor device according to claim 1, wherein each one of said helical threads has a helical twist approximately equal to 360°/N, where N is a number of helical threads for either one of said pair of rotors.

10. A screw rotor device for positive displacement of a working fluid, comprising:

a housing having an inlet port at a first end and an outlet port at a second end and a pair of cylindrical bores extending therebetween;

a first rotor rotatably mounted about a first axis between said first end and said second end of said housing, said first rotor having at least one helical thread with a first helix angle and a first cross-sectional shape in a plane perpendicular to said first axis;

a second rotor rotatably mounted about a second axis between said first end and said second end of said housing, said second rotor having at least one helical thread with a second helix angle opposite from said first helix angle and a second cross-sectional shape in a plane perpendicular to said second axis; and wherein said helical threads of said first rotor and said second rotor intermesh in a counter-rotating manner, wherein said first rotor has an identical number of helical threads as said second rotor and wherein said first rotor and said second rotor have a length approximately equal to a single pitch of said helical threads, said helical threads having a buttress thread shape in a lengthwise cross-section of said first rotor and said second rotor in a plane extending between said first axis and said second axis, wherein said buttress thread shape is comprised of parallel straight diagonal lines and a pair of opposing concave lines.

11. The screw rotor device according to claim 10, wherein said buttress thread shape is further comprised of a first pair of straight lines substantially parallel to said first axis and said second axis and located between said parallel straight diagonal lines and said opposing concave lines.

12. The screw rotor device according to claim 11, wherein said buttress thread shape is further comprised of a second pair of straight lines substantially parallel to and offset from said first pair of straight lines, wherein said first pair of straight lines are approximately the same length for each rotor and said second pair of straight lines are approximately the same length as the first pair of straight lines.

13. The screw rotor device according to claim 10, wherein said first cross-sectional shape and said second cross-sectional shape are each comprised of a major diameter arc, a minor diameter arc, a concave curve between said major diameter arc and said minor diameter arc, and a convex curve between said minor diameter arc and said major diameter arc.

14. The screw rotor device according to claim 13, wherein said first cross-sectional shape and said second cross-sectional shape are identical and wherein said parallel straight diagonal lines comprise at least one-third of said length of said first rotor and said second rotor.

15. The screw rotor device according to claim 10, wherein each of said first rotor and said second rotor further comprises a plurality of helical threads, each one of said helical threads having a helical twist approximately equal to 360° N, where N is the number of helical threads.

16. The screw rotor device according to claim 10, further comprising a valve in fluid communication with said outlet port, wherein said first rotor and said second rotor confine the working fluid to a space within said housing that is in fluid communication with said outlet port.

17. A screw rotor device for positive displacement of a working fluid, comprising:

a housing having an inlet port at a first end and an outlet port at a second end and a pair of cylindrical bores extending therebetween;

a pair of intermeshing rotors rotatably mounted about a respective pair of axes between said first end and said second end of said housing, wherein each one of said pair of rotors has an identical number of helical threads and has a length less than approximately a single pitch of said helical threads, said helical threads having a buttress thread shape in a lengthwise cross-section of said pair of rotors in a plane extending between said pair of axes, wherein said buttress thread shape is comprised of parallel straight diagonal lines, a pair of opposing concave lines, a first pair of straight lines substantially parallel to said pair of axes and located between said parallel straight diagonal lines and said opposing concave lines, and a second pair of straight lines substantially parallel to and offset from said first pair of straight lines, wherein said second pair of straight lines are substantially the same length as said first pair of straight lines, and said parallel straight diagonal lines are more than three times as long as said first and second pair of straight lines combined, and wherein each one of said pair of rotors has a concave/convex cross-sectional shape in a plane perpendicular to said pair of axes.

18. The screw rotor device according to claim 17, wherein said concave/convex cross-sectional shape is identical for said pair of rotors and is comprised of a major diameter arc, a minor diameter arc, a concave curve between said major diameter arc and said minor diameter arc and a convex curve between said minor diameter arc and said major diameter arc, wherein said concave curve on each one of said rotors is defined by a path of said major diameter arc on the other of said rotors and said convex curve has a continually decreasing radius from a radius of said major diameter arc to a radius of said minor diameter arc.

19. The screw rotor device according to claim 17, wherein each one of said rotors has a pair of helical threads and said length of said rotors is approximately equal to said single pitch of said helical threads.

20. The screw rotor device according to claim 17, wherein each one of said rotors has a major diameter and a minor diameter, said major diameter being approximately twice as long as said minor diameter.

* * * * *